US005821019A

United States Patent [19]

Nguyen

[11] Patent Number: 5,821,019

[45] Date of Patent: Oct. 13, 1998

[54] COMPOSITE ORGANIC PHOTOCONDUCTOR HAVING PARTICULATE CHARGE TRANSPORT LAYER

[75] Inventor: Khe C. Nguyen, Los Altos, Calif.

[73] Assignee: Hewlett-Packard Company, Palo Alto, Calif.

[21] Appl. No.: 634,460

[22] Filed: Apr. 18, 1996

[51] Int. Cl.[6] ..... G03G 5/047; G03G 13/22

[52] U.S. Cl. ..... 430/58; 430/57; 430/120

[58] Field of Search ..... 430/57, 58, 120

[56] References Cited

U.S. PATENT DOCUMENTS

| | | | |
|---|---|---|---|
| 5,221,591 | 6/1993 | Bugner et al. | 430/58 |
| 5,288,573 | 2/1994 | Hung et al. | 430/58 |
| 5,305,586 | 4/1994 | Pai et al. | 430/58 |
| 5,364,727 | 11/1994 | Nguyen | 430/59 |
| 5,403,686 | 4/1995 | Bugner et al. | 430/58 |

*Primary Examiner*—Roland Martin
*Attorney, Agent, or Firm*—Timothy Rex Croll

[57] ABSTRACT

A composite organic photoconductor for electrophotography is described. The composite photoconductor includes a conductive support, a charge generation layer and a particulate charge transport layer disposed between the conductive support and the charge generation layer. The charge transport layer is formed from a first colorant composition comprising a particulate pigment embedded in a polymeric matrix. The charge generation layer is formed from a second colorant composition which comprises either a pigment or a dye. The charge transport layer has an infrared absorption maximum of about 740 nm, and the charge generation layer has an infrared absorption maximum greater than about 770 nm. The composite organic photoconductor exhibits both good electrophotographic response and superior thermal stability over a range of operating conditions, and is thus useful in a number of electrophotographic processes such as those employing charging, exposing and developing operations to form images.

22 Claims, 1 Drawing Sheet

COMPOSITE ORGANIC PHOTOCONDUCTOR HAVING PARTICULATE CHARGE TRANSPORT LAYER

TECHNICAL FIELD

The invention relates generally to a photoconductor for use in electrophotography. More particularly, the invention relates to a composite organic photoconductor having a layered structure which includes a charge generation layer and a charge transport layer. The composite organic photoconductor is useful in electrophotographic processes such as those employing charging, exposing and developing operations to form images.

BACKGROUND OF THE INVENTION

In electrophotographic imaging processes, latent images are created on the surface of a charged photoconducting material by selectively exposing areas of the surface to electromagnetic radiation. This creates a difference in the electrostatic charge density between exposed and unexposed areas of the surface. A latent electrostatic image is developed into a visible image using electrostatic toners containing pigment and thermoplastic components. Electrostatic toners can be either dry or liquid compositions. The electrostatic toner particles are selectively attracted to the areas of the photoconductor surface that are either exposed or unexposed, depending on the relative electrostatic charges of the photoconductor surface, the development electrode and the toner. The photoconductor surface may be either positively or negatively charged, and the toner composition may likewise contain negatively or positively charged particles. In electrophotographic laser printers, it is preferable that the photoconductor and the toner have the same polarity, but different levels of charge.

In order to create a real image, a sheet of paper or an intermediate transfer medium is given an electrostatic charge opposite that of the toner. The charged paper or transfer medium is passed by the photoconductor surface to attract the toner in the pattern provided by the latent image on the surface of the photoconductor. Real image definition, or "resolution," is partially a function of toner particle size, where smaller particle sizes are generally capable of providing higher resolution images.

A number of liquid toner systems have been described which include pigment and thermoplastic components dispersed in a liquid carrier medium such as special hydrocarbon liquids. Liquid toner systems have higher resolution capabilities than dry toner systems since the average liquid toner particle size is much smaller than that of dry toner particles. Liquid toners have been developed, in part, to meet a recognized need in the art for providing high resolution multi-colored images in electrophotographic laser printing.

A variety of different photoconducting materials can be used to provide electrophotographic photoconductor surfaces. For example, inorganic compounds such as amorphous silicon, arsenic selenide, cadmium sulfide, selenium, cadmium selenide, titanium oxide and zinc oxide all function as adequate photoconductors. However, the use of such inorganic materials in modern equipment is limited due to their attendant high production costs, lack of adequate high-speed responsiveness to conventional laser or other light-emitting diodes (LEDs) and the toxicity associated with such materials.

More recently, photoconductor surfaces have been made from organic materials to provide organic photoconductors (OPCs). OPCs provide an inexpensive, nontoxic alternative to prior inorganic photoconductors. Particularly, it is easier to achieve appropriate spectral sensitivity in the near infrared range using an OPC, and such photoconductors also have higher speed capabilities than their inorganic counterparts. Conventional OPCs are generally negatively charging and are formed from a thin charge generation material that is disposed beneath a thicker charge transport layer. Negative-charging OPCs are particularly effective for use in xerographic copiers and printers used in xerographic systems, such as in low-end systems (i.e., 4–10 copies per minute) or high-end systems (i.e., greater than 50 copies per minute). Negative-charging OPCs are also effective in high image quality applications (greater than 1800 DPI), color proofing, lithographic plate printing and master xero-printing systems with life expectancies of less than 100 cycles.

Although negative-charging OPCs are useful in such electrophotographic applications, those photoconductors suffer from a number of drawbacks. Negative-charging OPCs generate large amounts of ozone during the negative corona-charging process. Equipment having a negative-charging OPC component may thus need to include ozone-absorbing materials or filters, or use contact negative-charging instead of corona-charging in order to avoid problems from ozone release. Despite the general effectiveness of these approaches in the reduction of unwanted ozone release, such remedial techniques do not provide attractive commercial solutions. Negative corona-charging typically results in reduced charge pattern uniformity which in turn results in greater pattern interference and reduced definition in the final image. Further, in liquid toner processes, greater charge stability can be developed in positively charged toners than in negatively charged toners. Accordingly, positive-charging OPCs are preferred, particularly in electrophotographic laser printing.

OPCs can be constructed as single or multiple layer structures supported by a suitable conducting substrate material. The substrate is generally configured as a drum, belt or the like. Multi-layered structures include a charge generation layer that is capable of absorbing light to create charged electron-hole pairs, and a charge transport layer which is able to transport generated charges. Known charge transport materials include various hydrazone, oxazole, triphenylmethane, arylamine, stilbene and enamine compounds. Known organic charge generating materials include various perylene, thiapyrrylium, anthranone, squarylium, bisazo, trisazo, and azulenium compounds, as well as organic dyes. The charge generation and charge transport materials are coated along with polymer binders onto conductive substrates. Typical binders include polyester resins, polycarbonate resins, acrylic resins, acryl-styrene resins and the like.

A variety of organic colorant materials have been used as charge generation materials in OPCs, including azo dyes, anthranone dyes, phthalocyanine dyes, perylene dyes and thialyrillium dyes. In basic applications, these organic colorants are combined with a plastic material at a suitable ratio, and the mixture coated onto a substrate to provide an OPC surface. In laser printing, the particular material used as the charge generating material should be highly sensitive to near infrared light in the range of from about 700 to 900 nm in order to operate with light sources that emit in that range. The sensitivity of a particular material depends heavily on the purity of the material used.

A number of specific morphologies of phthalocyanine dyes are known to exhibit excellent photoconductivity, particularly in the near infrared range. For example, metal-free phthalocyanines (also referred to as "$H_2Pc$" or "$H_2Pcs$"), are widely used as photoconducting materials. The α-type and β-type crystal forms of $H_2Pc$ compounds can be produced using conventional methods. Typically, α-type $H_2Pc$ crystals are formed by treating metal-containing phthalocyanines with an acid such as sulfuric acid to remove the metal. Suitable metal-containing phthalocyanines include lithium phthalocyanine, sodium phthalocyanine, calcium phthalocyanine, magnesium phthalocyanine and the like. Metal-free phthalocyanines can also be produced directly from phthalodinitrile, aminoiminoisoindolenine and alkoxy-iminoisoindolenine.

The use of X-form $H_2Pcs$ has also been described in U.S. Pat. No. 3,357,989 to Byrne et al. In Byrne et al., the X-form $H_2Pc$ is generally characterized with respect to its preparation, the relationship between the crystal form and its electrophotographic characteristics, and structural analyses. X-form $H_2Pc$ can be prepared by treating β-type $H_2Pc$ with sulfuric acid to obtain an α-type $H_2Pc$ which is then ball-milled for an extended period of time. The crystal structure of X-form $H_2Pc$ is apparently different from both α-type and β-type $H_2Pc$ based on X-ray diffraction patterns and like analyses. The infrared absorption spectra of α-type, β-type and X-form $H_2Pc$ are known and are described in, for example, the publication to Sharp et al. (1968) *J. Phys. Chem.* 27:3230.

Other morphologies, such as τ-type, η-type and η-type $H_2Pcs$ have also been described. The τ-form $H_2PC$ can be obtained by subjecting α-type, β-type or X-form $H_2Pc$ crystals to ball milling in an inert solvent along with a milling aid at an approximate temperature of 5° to 10° C. for up to about 20 hours. The X-ray diffraction pattern of τ-type $H_2Pc$ is substantially similar to that of the X-form crystals. However, τ form $H_2Pc$ can be clearly distinguished from the other $H_2Pc$ crystal forms by its infrared absorption spectrum. The η-form of $H_2Pc$ can be represented by the general formula $Pc\text{-}(CONH_2NHC_2H_5)_{11}$, wherein Pc represents a phthalocyanine nucleus, and the numerical value after the parenthesis represents a mean substitution number. The η and η forms are mixed compositions containing 100 parts by weight of metal-free phthalocyanine and up to 50 parts by weight of a second component, such as a metal-containing phthalocyanine. The infrared absorption spectra of the η-type and η-type $H_2Pcs$ are known and have been described, for example, in U.S. Pat. No. 4,619,879 to Kakuta et al.

Single-layer electrophotographic OPCs can be provided using the above-described phthalocyanine dyes in the form of a mixture dispersed within an inert polymeric binder matrix. In such phthalocyanine/binder matrices, both photogeneration of charge and charge transport occur in the phthalocyanine particles, thereby enabling the single-layer photoconductor configuration. These single-layer systems are regarded as very good positive-charging OPCs due to the hole (positive charge) transportability of the phthalocyanine dye particles.

A single-layer OPC suitable for use in electrophotography has been described in U.S. Pat. No. 4,218,528 to Shimada et al. The photoconductor is formed from a phthalocyanine dye dispersed in a phenol resin at a weight ratio of dye to resin of 1:3 to 1:20. U.S. Pat. No. 5,087,540 to Murakami et al. describes a positive-charging, single layer OPC formed from X-form and/or τ-type $H_2Pcs$ which are dispersed in a binder resin in both a molecular and particulate state. In order to provide such a dispersion, the phthalocyanine compound must be agitated in a solvent with the binder resin over a period of several hours to several days. U.S. Pat. No. 5,424,158 to Murakami et al. also describes a positive-charging, single-layer OPC composition. The single-layer photoconductive composition includes a binder polymer having a particulate electron acceptor substance, e.g., a quinine derivative, and a molecular charge generating substance, such as an $H_2Pc$, dispersed in the binder polymer.

Single-layer OPC formats have been widely used since they are relatively easy to manufacture and exhibit good hole-transport capabilities. However, their performance and stability in liquid toner systems has yet to be established. It is thought that the effect of commonly used liquid toners (for example those containing charge control agents) in single-layer OPC systems will result in contamination and surface charge degradation of the OPC. This would greatly limit the usefulness of single-layer OPCs in high-speed, high-volume applications.

A number of multi-layer OPCs suitable for use in electrophotography have also been described. These multi-layer systems are generally more able to withstand harsh physical conditions than are single-layer OPCs. For example, U.S. Pat. No. 4,559,287 to McAneney et al. describes a positive-charging, multi-layer OPC having a molecular species which serves as both an electron acceptor and an electron transporter disposed within the outermost OPC layer. Although such an OPC is useful in high-speed applications, it is formed from derivatives of fluorenylidene methane, materials not generally desirable because of their poor solubility, incompatibility with common binders, and low reaction yield. Further, fluorenylidene methane derivatives tend to be highly carcinogenic.

U.S. Pat. No. 4,891,288 to Fujimaki et al. describes a multi-layer, phthalocyanine-based positive-charging OPC in which the relative positions of the charge generation and charge transport layers have been reversed. This format, however, requires the addition of a protective overcoat to avoid mechanical damage to the OPC. The overcoat is necessary since the outermost pigment-containing layer is very vulnerable to the harsh physical conditions provided by developer components, the transfer medium and the cleaning components of electrophotographic systems.

U.S. Pat. No. 5,312,705 to Tsuchiya et al. describes a multi-layer OPC wherein a positive charge generation layer is formed from a dispersion of X-form and/or τ-type $H_2Pc$ in a resin binder. The dispersion is mixed such that at least a portion of the X-form and/or τ-type $H_2Pc$ is dissolved in a solvent. These multi-layer OPCs have been widely used in high-speed systems; however, such OPCs are limited in their thermal stability. Accordingly, there remains a need to provide a thermally stable multi-layer OPC system capable of use in high-speed and/or high-volume electophotographic devices, particularly in laser printers which use liquid toners.

SUMMARY OF THE INVENTION

It is a primary object of the invention to address the above-described need in the art by providing a composite organic photoconductor including a charge transport layer formed from transport materials having both enhanced xerographic response and increased thermal stability. The composite OPC includes a conductive support, a charge generation layer and an intervening charge transport layer disposed between the conductive support and the charge generation layer. The charge transport layer is formed from a first colorant composition having an infrared absorption maximum of about 740 nm. The first colorant is a pigment which is present in the particulate form. The charge generation layer includes a second colorant composition having an infrared absorption maximum greater than about 770 nm. The second colorant can be either a pigment or a dye.

The charge transport layer is formed using a first colorant composition present as a polymeric matrix of a first binder material with a hydrogen phthalocyanine ($H_2Pc$) pigment embedded therein. The first binder material can be a thermoplastic or thermoset resin, a polyvinyl acetal, a polyvinyl butyral or a polystyrene.

In one aspect of the invention, the charge transport layer is formed from a polymeric matrix of a first binder material having a specific particulate X-form $H_2Pc$ colorant embedded therein. The particulate charge transport layer has an infrared absorption maximum at about 740 nm. The polymeric matrix is formed using a terpolymer comprising repeating units of the structure

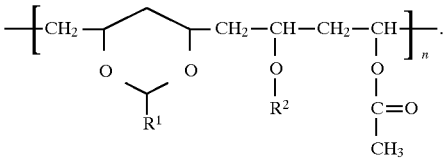

[I]

In structure [I], $R^1$ is lower alkyl substituted with 0–4 substituents selected from the group consisting of lower alkoxy, halogen and amino, or phenyl substituted with 0–3 substituents selected from the group consisting of lower alkoxy, halogen, amino and nitro. $R^2$ is hydrogen, —$R^3$—NH—$R^4$ or —$R^3$—OH, wherein $R^3$ is (a) lower alkylene substituted with 0–4 substituents selected from the group consisting of lower alkoxy, halogen and amino, and optionally containing 1–3 ether linkages, (b) phenylene substituted with 0–3 substituents selected from the group consisting of lower alkoxy, halogen, amino and nitro, or (c) —CO—Y—, wherein Y is lower alkylene substituted with 0–4 substituents selected from the group consisting of lower alkoxy, halogen and amino, and optionally containing 1–3 ether linkages, or phenylene substituted with 0–3 substituents selected from the group consisting of lower alkoxy, halogen, amino and nitro. $R^4$ is (a) lower alkylene substituted with 0–4 substituents selected from the group consisting of lower alkoxy, halogen and amino, (b) phenylene substituted with 0–3 substituents selected from the group consisting of lower alkoxy, halogen, amino and nitro, or (c) a lower acyl group, and n is an integer indicating the number of units in the polymer, generally although not necessarily providing the polymer with a (weight average) molecular weight in the range of about 10,000 to 3,000,000, more typically in the range of about 100,000 to 1,000,000.

In another aspect of the invention, the charge transport layer comprises a colorant composition that is a dispersion of an X-form $H_2Pc$ colorant in a polymer matrix. The matrix is formed from a first type of crosslinkable copolymer having first mer units with the general structure

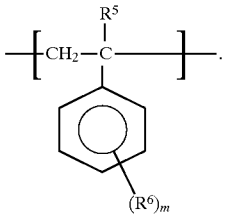

[II]

In structure [II], $R^5$ is hydrogen, lower alkyl substituted with 0–4 substituents selected from the group consisting of lower alkoxy, halogen and amino, or phenyl substituted with 0–3 substituents selected from the group consisting of lower alkoxy, halogen, amino and nitro. $R^6$ is lower alkyl, lower alkoxy, halogen, amino or nitro, and m is an integer in the range of 1–5 inclusive. The crosslinkable copolymer has second mer units with the general structure

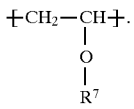

[III]

In structure [III], $R^7$ is hydrogen, —$R^8$—NH—$R^9$ or —$R^8$—OH, wherein $R^8$ is (a) lower alkylene substituted with 0–4 substituents selected from the group consisting of lower alkoxy, halogen and amino, and optionally containing 1–3 ether linkages, (b) phenylene substituted with 0–3 substituents selected from the group consisting of lower alkoxy, halogen, amino and nitro, or (c) —CO—Z—, wherein Z is lower alkylene substituted with 0–4 substituents selected from the group consisting of lower alkoxy, halogen and amino, or phenylene substituted with 0–3 substituents selected from the group consisting of lower alkoxy, halogen, amino and nitro. $R^9$ is (a) lower alkylene substituted with 0–4 substituents selected from the group consisting of lower alkoxy, halogen and amino, (b) phenylene substituted with 0–3 substituents selected from the group consisting of lower alkoxy, halogen, amino and nitro, or (c) a lower acyl group. The first and second mer units are present in the crosslinkable copolymer of structure [III] at a ratio of approximately 1:1.

In a related aspect of the invention, the polymeric matrix used to provide the charge transport layer in the composite OPC can be formed from a second type of crosslinkable copolymer having first mer units with the general structure [II], and second mer units with the general structure

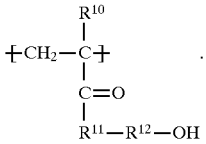

[IV]

In structure [IV], $R^{10}$ is hydrogen, lower alkyl substituted with 0–4 substituents selected from the group consisting of lower alkoxy, halogen and amino, or phenyl substituted with 0–3 substituents selected from the group consisting of lower alkoxy, halogen, amino and nitro. $R^{11}$ is —O— or —NH—. $R^{12}$ is an alkylene group of 1 to 24 carbon atoms or an arylene group of 1 to 24 carbon atoms. The first and second mer units are present in the crosslinkable copolymer at a ratio of approximately 1:1.

In the practice of the invention, copolymers containing mer units [II] and [III], or mer units [II] and [IV] will generally have a (weight average) molecular weight in the range of about 10,000 to 3,000,000, more typically in the range of about 100,000 to 1,000,000.

It is also an object of the invention to provide a method for forming a composite organic photoconductive material for use in electrophotographic processes. The method generally includes the steps of: (1) providing a conductive support; (2) preparing a first colorant composition by dispersing a first colorant in a suitable binder material using an organic solvent that is capable of dissolving the binder material; (3) forming a charge transport layer on the conductive support by applying the colorant dispersion to the conductive support to provide a charge transport layer having an infrared absorption maximum of about 740 nm; (4) preparing a second colorant composition from a second colorant having an infrared absorption maximum greater than about 770 nm; and (5) applying the second colorant composition onto the charge transport layer to provide a charge generation layer having an infrared absorption maximum greater than about 770 nm.

It is yet a further object of the invention to provide an electrophotographic method which includes the step of first providing a composite organic photoconductor having a conductive support, a charge generation layer and an intervening charge transport layer disposed between the conductive support and the charge generation layer. As described above, the charge transport layer is formed from a first colorant composition having an infrared absorption maximum of about 740 nm. The charge generation layer is formed from a second colorant composition having an infrared absorption maximum greater than about 770 nm. The electrophotographic method is then carried out by: (1) establishing a uniform charge on the composite organic photoconductor; (2) exposing the composite organic photoconductor to light to form a latent image thereon; and (3) developing the latent image with a toner composition comprising pigment components.

DETAILED DESCRIPTION OF THE PREFERRED EMBODIMENTS

Figure 1:
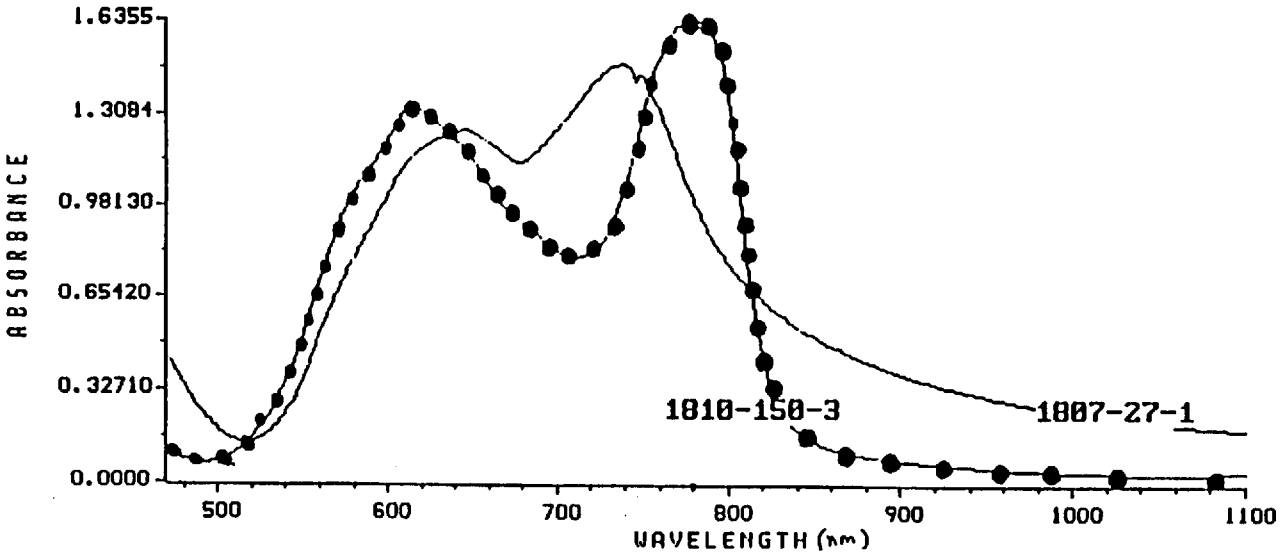
FIG. 1 depicts in graph form a comparison of the infrared absorption spectrum of an organic photoconductor formed from blue-shifted X-form $H_2Pc$ colorant particles (--) and the absorption spectrum of a photoconductor formed from untreated X-form $H_2Pc$ colorant particles (●).

A. Definitions:

Before the invention is described in detail, it is to be understood that this invention is not limited to the particular component parts of the devices or methods described, as such may vary. It is also to be understood that the terminology used herein is for purposes of describing particular embodiments only, and is not intended to be limiting. It must be noted that, as used in the specification and the appended claims, the singular forms "a," "an" and "the" include plural referents unless the context clearly dictates otherwise. Thus, for example, reference to "a solvent" includes mixtures of two or more solvents, reference to "a binder" includes two or more binders, reference to "an electron/hole pair" includes two or more such pairs, and the like.

In this specification and in the claims which follow, reference will be made to a number of terms which shall be defined to have the following meanings:

"Electrophotography" is broadly defined herein to include those processes in which electromagnetic radiation is used to create an electrical image analog. The electrical analog is, in turn, manipulated through a series of steps that result in a real image. More particularly, "electrophotography" refers to an electrostatic image-forming process wherein electromagnetic radiation is used to form a latent electrostatic image on a photoconductive, insulating medium. The latent electrostatic image is "developed" into a visible image using electrostatic toners containing pigment and thermoplastic components. During the development process, the electrostatic toner is selectively attracted to areas of the photoconductor surface that have been either exposed or unexposed, depending on the relative electrostatic charges of the photoconductor surface, the development electrode and the toner. The visible image can then be transferred to a medium having an electrostatic charge opposite that of the toner to provide a real image.

A "photoconductor" refers to any nonmetallic conductive solid whose conductivity increases upon absorption of electromagnetic radiation. A "photoconductive material" is defined herein as a photoconductor layer of a selected thickness which can be used in an electrophotographic device. The optimal thickness of a photoconductive material is determined by the potential required for development of an electrostatic image, which is generally in the range of about 300–800 V. The radiation exposure required to produce this potential provides a measure of the photosensitivity of the photoconductive material. A material that has a high photosensitivity is generally characterized as having: low activation energy for discharging in a desired spectral region, e.g., in the 600–900 nm infrared region; efficient charge generation capability which relates to the separation of photoexcited electron/hole pairs under the influence of an applied electric field; and efficient charge transport capability, i.e. the transport of a mobile charge through the photoconductive layer. A photoconductive material can be either a single layer or a composite structure.

The term "toner" refers to either "dry" or "liquid" compositions which contain thermoplastic and colorant components. Dry toner compositions contain particles of a thermoplastic powder having an average size of about 7–15 $\mu$m. The particles are colored by a dispersion of 5–10 wt. % carbon-black particles. Alternatively, colorants such as cyan, magenta, or yellow colorings, can be substituted for the carbon-black when the toner is to be used in a color-imaging process. By contrast, liquid toners have an average particle size in the sub-micron range. As with dry toners, liquid toners also include colorant and thermoplastic components; however, those components are dispersed in a liquid carrier medium, for example, a hydrocarbon liquid. Suitable hydrocarbon liquids are known in the art, including for example NORPAR 12® (Exxon Corporation).

The term "polymer" is intended to include both oligomeric and polymeric species, i.e., compounds which include two or more monomeric units, which may be a homopolymer or a copolymer. When a single generic structure is shown, e.g., as in formula (I), (II), (III), or (IV), it is to be understood that the polymers described may contain two or more different monomeric units represented by the single generic structure.

The term "homopolymer" intends a polymer incorporating a single species of monomer units. By contrast, the term "copolymer" refers to a polymer constructed from two or more chemically distinct species of monomer units in the same polymer. A "block copolymer" is a polymer which incorporates two or more segments of two or more distinct species of homopolymers or copolymers. A block copolymer that contains three distinct monomer units is referred to herein as a "terpolymer."

The term "thermoplastic resin" encompasses linear polymers that will repeatedly soften and flow when heated and harden when cooled. Almost all uncrosslinked polymers that have been produced by chain polymerization are thermoplastics. Exemplary thermoplastic resins include, for example, styrene, acrylics, cellulosics, polyethylenes, vinyls, nylons and fluorocarbons.

A "thermoset resin" or "thermosetting resin" is a polymer material that solidifies when first heated under pressure, and which will not flow when reheated. Thermoset resins are generally formed by crosslinking a linear polymer, and are thus dimensionally stable and refractive to a wide variety of conditions due to their rigid, crosslinked network structure. Exemplary thermoset resins include, for example, epoxies, melamines, phenolics and ureas.

The term "alkyl" as used herein refers to a branched or unbranched saturated hydrocarbon group of 1 to 24 carbon atoms, such as methyl, ethyl, n-propyl, isopropyl, n-butyl, isobutyl, t-butyl, octyl, decyl, tetradecyl, hexadecyl, eicosyl, tetracosyl and the like. Preferred alkyl groups herein contain 1 to 12 carbon atoms. The term "lower alkyl" intends an alkyl group of one to six carbon atoms.

The term "alkylene" as used herein refers to a difunctional saturated branched or unbranched hydrocarbon chain containing from 1 to 24 carbon atoms. "Lower alkylene" refers to alkylene linkages containing from 1 to 6 carbon atoms, and includes, for example, methylene ($—CH_2—$), ethylene ($—CH_2CH_2—$), propylene ($—CH_2CH_2CH_2—$), 2-methylpropylene ($—CH_2—CH(CH_3)—CH_2—$), hexylene ($—(CH_2)_6—$) and the like.

The term "alkoxy" as used herein intends an alkyl group bound through a single, terminal ether linkage; that is, an "alkoxy" group may be defined as —OR where R is alkyl as defined above. A "lower alkoxy" group intends an alkoxy group containing one to six, more preferably one to four, carbon atoms.

The term "aryl" as used herein refers to a monocyclic aromatic species of 5 to 7 carbon atoms, typically phenyl. The term "arylene" refers to a difunctional aromatic moiety containing from 1 to 24 carbon atoms. Both aryl and arylene groups are optionally substituted with one to four, more preferably one to two, lower alkyl, lower alkoxy, hydroxy, and/or nitro substituents or the like.

"Halo" or "halogen" refers to fluoro, chloro, bromo or iodo, and usually relates to halo substitution for a hydrogen atom in an organic compound. Of the halos, fluoro is typically preferred. "Halogenated" thus refers to a group in which at least one hydrogen atom, and optionally all hydrogen atoms, are replaced with halo atoms.

"Optional" or "optionally" means that the subsequently described circumstance may or may not occur, and that the description includes instances where said circumstance occurs and instances where it does not. For example, the phrase "optional crosslinking agent" means that a crosslinking agent may or may not be present and that the description includes both the instance when the crosslinking agent is present and the instance when the crosslinking agent is not present.

B. The Novel Compositions:

In one embodiment of the invention, a composite OPC structure is provided which uses a novel particulate first colorant composition as a transport material in a charge transport layer, and suitable second colorant composition as a charge generation material in a charge generation layer. The colorant composition used as the charge transport material is generally a polymeric matrix of a binder material having $H_2Pc$ pigment crystals embedded therein. The $H_2Pc$ pigment crystals are in the particulate state, rather than the molecular state. The colorant composition has been found to be thermally stable at high manufacturing and operating temperatures, which can normally range up to about 200° C. during manufacturing processes and up to about 70° C. during operation. The thermally stable particulate colorant composition exhibits good hole transport mobility and provides a low charge injection barrier between the charge generation layer and the charge transport layer. In this way, the particulate $H_2Pc$ charge transport material of the invention is able to provide the increased xerographic response characteristic of prior multi-layer OPCs, without suffering a concomitant loss of thermal stability.

It is a purpose of the invention to provide a composite OPC structure for use in electrophotographic processes. The composite OPC includes an inner conductive support, an intermediate particulate charge transport layer and an outermost charge generation layer. The charge transport layer is formed using a first colorant composition which has an infrared absorption maximum of about 740 nm. The first colorant composition can be formed from an X-form hydrogen phthalocyanine pigment starting material using a combination of dry and wet milling processes. Thus, in one aspect of the invention, a dry milling process is used to pretreat X-form $H_2Pc$ crystals. The dry milling process is carried out in the absence of solvent or binder material, and provides pretreated X-form $H_2Pc$ crystals having reduced average particle size relative to the starting pigment.

Any suitable milling technique can be used in the dry milling process, wherein the X-form $H_2Pc$ pigment crystals are converted into a "vulnerable" form of reduced average particle size in the presence of milling aids and/or milling media. A number of suitable milling systems are generally known to those skilled in the art including, for example, dispersers, stirrers, Banbury mixers, ball mill, sweeco mill, agitator mill, attritor mill, sand mill, salt mill, and like devices. Milling media can include ceramic beads, glass beads, stainless steel beads, zirconium beads, combinations of two or more such beads, or the like. In salt mill systems, milling media can include, for example, sodium chloride, sodium hydrogen-carbonate, sodium sulfate, or the like.

The dry milling process is carried out in a suitable container, such as in a glass jar, ceramic pot, plastic jar, teflon-coated ceramic pot, or the like. The milling temperature is maintained in the general range of about 4° to 75° C., more preferably about 10° to 50° C. The milling temperature can be readily controlled using a water jacket, or by adding a water-soluble liquid to the milling system, for example, glycerine. After the dry milling process is complete, the particulate colorant is separated from the milling aids and/or media using ordinary purification techniques such as by filtering through a suitable mesh.

The dry milling process yields a pretreated $H_2Pc$ colorant that has not undergone any change in crystal form; however, the average size of the pigment crystals has been reduced three to four fold relative to the starting material. These pretreated crystals are thus rendered vulnerable to the effects of organic solvents and binder components when further processed using a wet milling technique.

Wet milling of the pretreated X-form $H_2Pc$ crystals is carried out along with a first binder material in one or more organic solvents to provide a colorant dispersion. The first binder material is a thermoplastic or thermoset resin, for example, a polyvinyl acetal, polyvinyl butyral, or a polystyrene. The colorant content can range from about 10 wt. % to 90 wt. % X-form $H_2Pc$ relative to the entire binder material-colorant composition. Preferably, the colorant content will range from about 13 wt. % to 25 wt. %. The pretreated colorant and binder material are wet-milled in the presence of one or more suitable organic solvents using any of the above-mentioned milling systems. A number of conventional organic milling solvents are known in the art. The particular solvent is selected for its ability to dissolve the binder material. For example, the solvent can be a ketone solvent (e.g., acetone, methyl ethyl ketone (MEK) or methyl isobutyl ketone (MIBK)), a furan (e.g., tetrahydrofuran (THF)), toluene, xylene, a chlorinated solvent (e.g., dichloromethane (DCM) or trichloroethylene (TCE)), or the like.

Optionally, emulsifiers or surfactants can be added to the wet milling system to improve milling efficiency. Once the wet milling process has been completed, milling aids and/or media, solvents and the like, are removed from the colorant composition using ordinary purification processes. The colorant composition is then coated using conventional coating equipment onto a clean, electrically conductive support substrate and dried thereon. A number of suitable coating techniques are known to those skilled in the art, including use of a wire-wound draw-down rod, a doctor blade applicator, or by spin or dip coating, to provide a uniform charge transport layer. The colorant composition is preferably coated onto the support substrate while the colorant composition is at ambient temperature, although the temperature of the colorant composition can be elevated or reduced according to customary coating practices. Drying is effected using conventional techniques such as vacuum drying. If a thermoplastic binder is used, the drying temperature and drying time will depend on the boiling point of the coating solvent. If a crosslinkable, thermoset binder is used, the drying conditions are optimized to ensure that the coating solvent is completely removed from the coating to allow the binder to crosslink. The coating technique is carried out such that after drying the charge transport layer will have a thickness of from about 2 to 50 $\mu$m, more preferably from about 2 to 25 $\mu$m, and most preferably from about 4 to 12 $\mu$m.

By using the above-described two-step milling process, a novel particulate $H_2Pc$ charge transport material is provided which retains the average particle size of the pretreated colorant material (X-form $H_2Pc$), but which has undergone a bathochromic shift toward a shorter wavelength (i.e., a blue shift) at the completion of the two-part milling process. Particularly, a charge transport layer formed using untreated X-form $H_2Pc$ pigment particles which have been wet-milled with a polyvinyl binder in THF will exhibit a maximum infrared absorption at about 780 nm. By contrast, X-form $H_2Pc$ pigment particles that have been pretreated as described above, and then subjected to the same wet milling process, have been found herein to exhibit a sharp infrared absorption maximum at about 740 nm. This blue-shifted product is thus not identical to other forms of metal-free phthalocyanines, such as the $\alpha$-, $\beta$-, or $\gamma$-form $H_2Pcs$. The blue-shifted product also exhibits different infrared absorption characteristics from X-form $H_2Pc$.

The composite OPC structure is completed by forming a charge generation layer on the charge transport layer. The charge generation layer comprises a second colorant composition having an infrared absorption maximum of at least about 770 nm, preferably at about 780 nm. The second colorant composition includes a pigment or a dye component which is selected to enhance the xerographic response of the composite OPC by reducing the charge induction period required of the OPC when the second colorant composition is used in combination with the novel particulate charge transport material of the invention.

In particular aspects of the invention, the second colorant composition includes a phthalocyanine pigment, for example, an $\alpha$-, $\beta$- or X-form hydrogen phthalocyanine ($H_2Pc$), vanadyl phthalocyanine (VOPc), magnesium phthalocyanine (MgPc), chloroindium phthalocyanine (ClInPc), titanyl phthalocyanine (TiOPc) or halogenated titanyl phthalocyanine, hydroxy gallium phthalocyanine (HOGaPc), bromoindium phthalocyanine (BrInPc), zinc phthalocyanine (ZnPc), and alpha-, beta- or epsilon-form copper phthalocyanine (CuPc) pigment. Alternatively, the second colorant composition can include a dye, such as a Pyrrollo-pyrrole dye, a cyano dye, or a squarylium dye. An X-form $H_2Pc$ is preferred, as such pigments exhibit an infrared absorption maximum of about 780 nm, a wavelength well matched with gallium arsenide (GaAs) laser diodes that emit light at 780 nm. GaAs laser diodes are commonly used as radiation sources in modern electrophotographic equipment such as laser printers.

The charge generation layer is formed on the charge transport layer using known techniques. Typically, the charge generation layer is applied to the charge transport layer to have a final thickness of about 0.1 to 3 $\mu$m. In one configuration, the charge generation layer is formed as a thin film of the second colorant composition that has been deposited on the charge transport layer using vacuum sublimation. The charge generation layer can also be formed by coating the charge transport layer with an organic coating provided by dissolving the second colorant composition in a suitable organic solvent. Alternatively, a second colorant dispersion can be provided by combining the solvated second colorant composition with a suitable second binder material to yield a colorant dispersion that can then be coated onto the charge transport layer. The second binder material can be either a thermoplastic or thermoset resin, and the colorant can be present in the dispersion in quantities as low as about 0.1 wt. % relative to the second binder material.

When the second colorant composition is a dispersion, the colorant and the binder material can be combined using the above-described wet-milling systems. Once the wet-milling process has been completed, milling aids and/or media, solvents and the like are removed from the colorant. The second colorant composition is then deposited on the charge transport layer using conventional coating equipment and then dried thereon. As noted above, a number of suitable coating techniques are known to those skilled in the art, including use of a wire-wound draw-down rod, doctor blade applicator, or spin or dip coating methods. If a thermoplastic binder is used, the drying temperature and drying time will depend on the boiling point of the coating solvent.

The above-described composite OPC overcomes a number of problems that have been associated with prior photoconductor systems by providing enhanced xerographic response, increased thermal stability, good hole charge transportability and reduced charge injection barrier between the charge generation and charge transport layers. By using two different crystal forms of hydrogen phthalocyanine in two separate layers of a composite OPC structure, the present invention is able to provide a composite photoconductor having enhanced photosensitivity capabilities similar to the capabilities of prior multi-layer systems, while avoiding problems associated with thermal instability that has been characteristic of such devices.

In the practice of the invention, the specific crystal form of the $H_2Pc$ colorant can be embedded in a wide variety of polymer matrices to provide a particulate charge transport layer having a near infrared absorption maximum at about 740 nm. In one aspect of the invention, the pretreated X-form $H_2Pc$ colorant is dispersed in a polymer matrix formed from a terpolymer having the structure

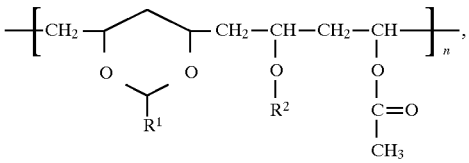

[I]

wherein $R^1$, $R^2$ and n are as defined above.

Alternatively, the terpolymer can be selected so that the $R^1$ moiety includes a substituent group such as an —I, —SH, —$NO_2$, —CN, —$NH_2$, —$SO_2$ or —OX, wherein X is either hydrogen or lower alkyl. In a related aspect of the invention, the second colorant composition can comprise a second pigment or dye component dispersed in the terpolymer. A number of specific terpolymers useful in the practice of the invention are presented below in Table 1.

TABLE 1

| Sample No. | General Structure | $R^1$ | $R^2$ | $R^3$ | $R^4$ |
|---|---|---|---|---|---|
| 1-1 | (I) | $-CH_2CH_2CH_3$ | $-R^3-OH$ | $-CH_2-$ | – |
| 1-2 | (I) | $-CH_2CH_2CH_3$ | $-R^3-OH$ | $-CH_2CH_2-$ | – |
| 1-3 | (I) | $-CH_2CH_2CH_3$ | $-R^3-OH$ | $-CH_2CH_2OCH_2CH_2-$ | – |
| 1-4 | (I) | $-CH_2CH_2CH_3$ | $-R^3-OH$ | $-COCH_2-$ | – |
| 1-5 | (I) | $-CH_2CH_2CH_3$ | $-R^3-OH$ | $-COCH_2CH_2-$ | – |
| 1-6 | (I) | $-CH_2CH_2CH_3$ | $-R^3-OH$ | 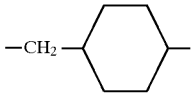 | – |
| 1-7 | (I) | $-CH_2CH_2CH_3$ | $-R^3-OH$ | 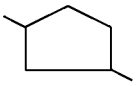 | – |
| 1-8 | (I) | $-CH_2CH_2CH_3$ | $-R^3-OH$ | 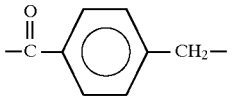 | – |
| 1-9 | (I) | $-CH_2CH_2CH_3$ | $-R^3-OH$ | 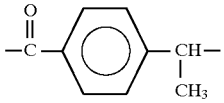 | – |
| 1-10 | (I) | $-CH_2CH_2CH_3$ | $-R^3-OH$ | 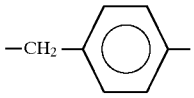 | – |
| 1-11 | (I) | $-CH_2CH_2CH_3$ | $-R^3-OH$ | 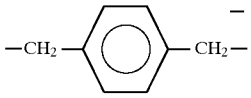 | – |
| 2-1 | (I) | $-CH_2CH_2CH_3$ | $-R^3-NH-R^4$ | $-CH_2-$ | H |
| 2-2 | (I) | $-CH_2CH_2CH_3$ | $-R^3-NH-R^4$ | $-CH_2CH_2-$ | H |
| 2-3 | (I) | $-CH_2CH_2CH_3$ | $-R^3-NH-R^4$ | $-CH_2CH_2OCH_2CH_2-$ | H |
| 2-4 | (I) | $-CH_2CH_2CH_3$ | $-R^3-NH-R^4$ | $-COCH_2-$ | H |
| 2-5 | (I) | $-CH_2CH_2CH_3$ | $-R^3-NH-R^4$ | $-COCH_2CH_2-$ | H |
| 2-6 | (I) | $-CH_2CH_2CH_3$ | $-R^3-NH-R^4$ | 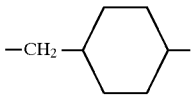 | H |
| 2-7 | (I) | $-CH_2CH_2CH_3$ | $-R^3-NH-R^4$ | 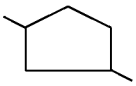 | H |
| 2-8 | (I) | $-CH_2CH_2CH_3$ | $-R^3-NH-R^4$ | 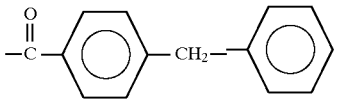 | |
| 2-9 | (I) | $-CH_2CH_2CH_3$ | $-R^3-NH-R^4$ | 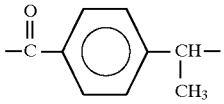 | H |
| 2-10 | (I) | $-CH_2CH_2CH_3$ | $-R^3-NH-R^4$ | 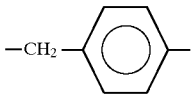 | H |
| 2-11 | (I) | $-CH_2CH_2CH_3$ | $-R^3-NH-R^4$ | 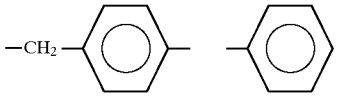 | |

TABLE 1-continued

| Sample No. | General Structure | $R^1$ | $R^2$ | $R^3$ | $R^4$ |
|---|---|---|---|---|---|
| 2-12 | (I) | $-CH_2CH_2CH_3$ | $-R^3-NH-R^4$ | 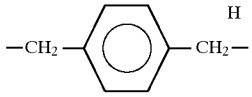 | H |
| 5-1 | (I) | $-CH_3$ | H | – | – |
| 5-2 | (I) | $-CH_2CH_2CH_3$ | H | – | – |
| 5-3 | (I) | 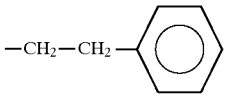 | H | – | – |

In another aspect of the invention, the pretreated X-form $H_2Pc$ colorant of the first colorant composition is dispersed in a polymer matrix formed from a crosslinkable copolymer having first mer units with the general structure

[II]

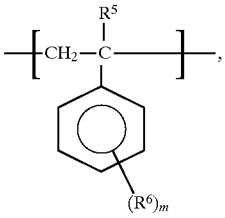

wherein $R^5$, $R^6$ and m are as defined hereinabove, and second mer units with the general structure

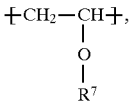

[III]

wherein $R^7$ is also as defined above.

A number particular crosslinkable copolymer binders of the above general type suitable for use in forming the first colorant composition of the invention are exemplified below in Table 2.

TABLE 2

| | First Mer Units | | | Second Mer Units | | | |
|---|---|---|---|---|---|---|---|
| Sample No. | General Structure | $R^5$ | $R^6$ | General Structure | $R^7$ | $R^8$ | $R^9$ |
| 3-1 | (II) | H | H | (III) | $-R^8-OH$ | $-CH_2CH_2-$ | – |
| 3-2 | (II) | H | $-CH_3$ | (III) | $-R^8-OH$ | $-CH_2CH_2-$ | – |
| 3-3 | (II) | $-CH_3$ | H | (III) | $-R^8-OH$ | $-CH_2CH_2-$ | – |
| 3-4 | (II) | H | H | (III) | $-R^8-OH$ | 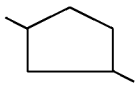 | – |
| 3-5 | (II) | H | $-OH$ | (III) | $-R^8-OH$ | $-CH_2CH_2-$ | – |
| 3-6 | (II) | H | $-OCH_3$ | (III) | $-R^8-OH$ | 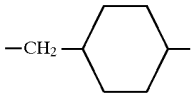 | – |
| 3-7 | (II) | H | H | (III) | $-R^8-OH$ | 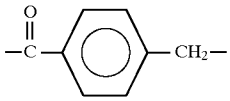 | – |
| 3-8 | (II) | H | H | (III) | $-R^8-OH$ | 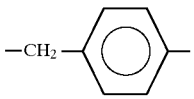 | – |
| 4-1 | (II) | H | H | (III) | $-R^8-NH-R^9$ | $-CH_2CH_2-$ | H |
| 4-2 | (II) | H | $-CH_3$ | (III) | $-R^8-NH-R^9$ | $-CH_2CH_2-$ | H |
| 4-3 | (II) | $-CH_3$ | H | (III) | $-R^8-NH-R^9$ | $-CH_2CH_2-$ | $-CH_3$ |
| 4-4 | (II) | H | $-CH_3$ | (III) | $-R^8-NH-R^9$ | $-CH_2CH_2-$ | H |

TABLE 2-continued

| | First Mer Units | | | Second Mer Units | | | |
|---|---|---|---|---|---|---|---|
| Sample No. | General Structure | $R^5$ | $R^6$ | General Structure | $R^7$ | $R^8$ | $R^9$ |
| 4-5 | (II) | $-CH_3$ | H | (III) | $-R^8-NH-R^9$ | $-CH_2CH_2-$ | 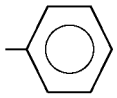 |
| 4-6 | (II) | H | H | (III) | $-R^8-NH-R^9$ | 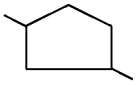 | H |
| 4-7 | (II) | H | $-OH$ | (III) | $-R^8-NH-R^9$ | $-CH_2CH_2-$ | $-CH_3$ |
| 4-8 | (II) | H | $-OCH_3$ | (III) | $-R^8-NH-R^9$ | 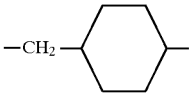 | H |
| 4-9 | (II) | H | H | (III) | $-R^8-NH-R^9$ | 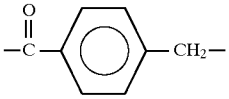 | H |
| 4-10 | (II) | H | H | (III) | $-R^8-NH-R^9$ | 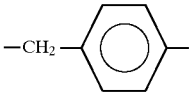 | H |

In a related aspect of the invention, the pretreated X-form $H_2Pc$ colorant is dispersed in a polymer matrix formed from a second general type of crosslinkable copolymer, having first mer units with the general structure [II] and second mer units with the general structure

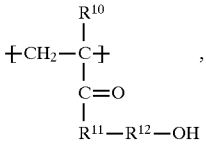

[IV]

wherein $R^{10}$, $R^{11}$ and $R^{12}$ are as defined earlier herein. A number of exemplary copolymers of this second general type are described below in Table 3.

TABLE 3

| | First Mer Units | | | Second Mer Units | | | |
|---|---|---|---|---|---|---|---|
| Sample No. | General Structure | $R^5$ | $R^6$ | General Structure | $R^{10}$ | $R^{11}$ | $R^{12}$ |
| 6-1 | (II) | H | H | (IV) | H | —O— | $—CH_2CH_2—$ |
| 6-2 | (II) | H | $—CH_3$ | (IV) | H | —O— | $—CH_2CH_2—$ |
| 6-3 | (II) | $—CH_3$ | H | (IV) | $—CH_3$ | —NH— | $—CH_2CH_2—$ |
| 6-4 | (II) | H | $—CH_3$ | (IV) | H | —NH— | $—CH_2CH_2—$ |
| 6-5 | (II) | H | H | (IV) | $—CH_3$ | —O— | $—CH_2CH_2CH_2—$ |

When crosslinkable binders are used in the formation of the particulate charge transport layer, the binder is cured using suitable methods, such as with heat or radiation (e.g., UV, IR, or E-beam radiation cure). Additionally, a bifunctional crosslinking agent can be added to the first colorant composition to help accelerate the crosslinking process. Suitable crosslinking agents are generally known, and include, for example, diisocyanates, triisocyanates, dialdehydes, trialdehydes, melamine formaldehydes, esters, diols, triols, dicarboxylic acids, tricarboxylic acids, epoxides, trialkoxy silanes, siloxanes, and diamino siloxanes.

Each of these binders can be prepared using conventional techniques well known to those skilled in the art of synthetic organic chemistry or which may be found in relevant texts, for example in Kirk-Othmer's *Encyclopedia of Chemical Technology*, in House's *Modern Synthetic Reactions*, in C. S. Marvel and G. S. Hiers' text, *ORGANIC SYNTHESIS*, Collective Volume 1, or the like.

It will be appreciated that composite OPCs having a particulate charge transport layer formulated with the novel colorant compositions of the invention are useful in a wide variety of electrophotographic applications. In particular, composite OPCs constructed according to the invention can be used in xerographic processes which involve charging, exposing and developing operations to form images. The composite OPCs are particularly well suited for use in high-speed laser printing processes for forming images of high resolution. Such processes can involve the use of liquid toner compositions in developing operations to provide high-resolution images. Further, composite OPCs constructed as described herein can be used in other electrophotographic techniques well known to those skilled in the art, or readily available in the relevant literature.

The following examples are intended to provide those of ordinary skill in the art with a complete disclosure and description of how to make and use the materials of the invention, and are not intended to limit the scope of what the inventor regards as the invention in any way. Efforts have been made to ensure accuracy with respect to numbers used (e.g., amounts, temperatures, etc.), but some experimental error and deviation should, of course, be allowed for. Unless indicated otherwise, parts are parts by weight, temperatures are in degrees centigrade, and pressure is at or near atmospheric.

EXAMPLE 1

Preparation of a Pre-treated Pigment Composition 40 g of X-form $H_2Pc$ (PROGEN I™, available from Zeneca Products) was milled in a teflon-coated ceramic jar for 5 hours using a milling medium prepared by combining 400 g of ceramic beads (5 mm diameter) with 150 g of Zirconia beads (2 mm). The milled colorant was then filtered through a 400 mesh filter to isolate the colorant from the milling medium.

EXAMPLE 2

Preparation of a Charge Transport Layer 1.6 g of the pre-treated colorant prepared in Example 1 was mixed with 8.4 g of polyvinyl butyral and 70 g of tetrahydrofuran (THF) in a 120 cc glass jar containing 70 g of glass beads (2 mm diameter) as a milling medium, and shaken for 48 hours using a paint-shaker to obtain a first colorant composition. The first colorant composition was separated from the milling medium to provide a purified colorant dispersion. The resultant dispersion was diluted with THF to achieve a solids (colorant) content of 10 wt. %, and then coated onto an aluminum/mylar (Al/Mylar®) film substrate using a doctor blade to achieve a final thickness of 7 $\mu$m (after drying). The coated substrate was dried at 80° C. for 2 hours, and then at 135° C. for an additional 2 hours.

EXAMPLE 3

Preparation of the Composite Organic Photoconductor 1.6 g of untreated X-form $H_2Pc$ was mixed with 8.4 g of polyvinyl butyral and 70 g of THF in a 120 cc glass jar containing 70 g of glass beads (2 mm diameter) as milling medium, and shaken for 48 hours with a paint-shaker to obtain a second colorant composition. After removing the milling medium, the second colorant composition was diluted with THF to obtain a solids content of 10 wt. %, and the solution was coated onto the charge transport layer produced in Example 2 to provide a charge generation layer. As above, a doctor blade was used to achieve a final thickness of 3 $\mu$m after drying. The charge generation layer was dried at 80° C. for 2 hours, and the resulting structure was wrapped around an aluminum drum (135 mm diameter) support to provide a composite OPC.

EXAMPLE 4

Infrared Absorption Spectra Studies

In order to compare the infrared absorption spectra of photoconductive layers formed from X-form $H_2Pc$ and blue-shifted X-form $H_2Pc$ colorants, the following experiment was carried out. The purified colorant dispersion formed in Example 2 was coated onto a transparent substrate of polyethylene telephthalate (PET) to achieve a final thickness of about 1 $\mu$m after being dried at 80° C. for 2 hours, and then at 135° C. for an additional 2 hours. The resulting photoconductive layer was used to assess the infrared absorption spectrum of the blue-shifted X-form $H_2Pc$ colorant composition of the present invention.

The second colorant composition formed in Example 3 was also coated onto a transparent PET substrate, and dried as above to achieve a photoconductive layer having a final thickness of about 1 $\mu$m that was used to assess the infrared absorption spectrum of untreated X-form $H_2Pc$ colorant.

The two photoconductive layers were each exposed to near infrared radiation, and their absorption spectra were obtained using routine methods of near infrared spectroscopy. Referring to FIG. 1, the spectra are compared; and, as can be seen, the blue-shifted X-form $H_2Pc$ colorant (indicated with the thin lined curve) exhibits an infrared absorption maximum at about 735 nm. Since the blue-shifted product has an absorption maximum at 735 nm, it is not photo-activated at a 780 nm exposure and therefore serves as an effective charge transport material in this operating range. By contrast, the nontreated X-form $H_2Pc$ colorant (indicated with solid circle (●) curve) exhibits an infrared absorption maximum at about 780 nm. In this manner, the nontreated X-form $H_2Pc$ colorant serves as an effective charge generation material at a 780 nm exposure.

EXAMPLE 5

Electrophotographic Response Studies

In order to assess the electrophotographic response of a composite OPC constructed according to the invention, the following comparison was carried out.

The composite OPC constructed in Example 3 was charged by exposure to a corona charger (monitored at +6 kV), exposed using a laser diode scanner print head (emitting at 780 nm), and then erased with a light emitting diode (LED) 770 nm. The initial surface charge ($V_0$) was measured at +650 V, the surface potential after exposure to the laser diode was measured at +35 V, and the surface potential after erasing was measured at 0 V.

In order to provide a comparison, a photoactive layer was constructed as follows. 1.6 g of untreated X-form $H_2Pc$ was mixed with 8.4 g of polyvinyl butyral and 70 g of THF in a 120 cc glass jar containing 70 g of glass beads (2 mm diameter) as milling medium, and shaken for 48 hours with a paint-shaker to obtain a colorant composition. After removing the milling medium, the colorant composition was diluted with THF to obtain a solids content of 10 wt. %, and the solution was coated onto an Al/Mylar film substrate using a doctor blade to achieve a final thickness of 10 $\mu$m (after drying). The coated substrate was dried at 80° C. for 2 hours, and then at 135° C. for an additional 2 hours to provide a single-layer organic photoconductor.

The single-layer OPC was charged by exposure to a corona charger (monitored at +6 kV), exposed using a laser diode scanner print head (emitting at 780 nm), and then erased with a light emitting diode (LED) 770 nm. The initial surface charge ($V_0$) was measured at about +660 V, the surface potential after exposure to the laser diode was measured at about +150 V, and the surface potential after erasing was measured at 10 V.

As can be seen, the composite OPC using the blue-shifted X-form $H_2Pc$ colorant composition as a charge transport material has a much lower residual voltage than the single-layer OPC formed from untreated X-form $H_2Pc$ crystals (e.g., +35 V compared to +150 V).

I claim:

1. A composite organic photoconductor, comprising a conductive support, a charge generation layer and a charge transport layer disposed between said conductive support and said charge generation layer, wherein:

(a) the charge transport layer comprises a first colorant composition comprised of a pigment having an infrared absorption maximum of about 740 nm; and (b) the charge generation layer comprises a second colorant composition having an infrared absorption maximum greater than about 770 nm, wherein the second colorant composition comprises a pigment or a dye.

2. The composite organic photoconductor of claim 1, wherein the first colorant composition comprises a polymeric matrix of a first binder material having a hydrogen phthalocyanine pigment embedded therein.

3. The composite organic photoconductor of claim 2, wherein the hydrogen phthalocyanine pigment is present as X-form crystals.

4. The composite organic photoconductor of claim 2, wherein the first binder material comprises a thermoplastic or thermoset resin.

5. The composite organic photoconductor of claim 4, wherein the first binder material is selected from the group consisting of polyvinyl acetal, polyvinyl butyral, and polystyrene.

6. The composite organic photoconductor of claim 3, wherein the X-form hydrogen phthalocyanine is present at 10 wt. % to 90 wt. % relative to the first binder material.

7. The composite organic photoconductor of claim 6, wherein the X-form hydrogen phthalocyanine is present at 13 wt. % to 25 wt. % relative to the first binder material.

8. The composite organic photoconductor of claim 4, wherein the first binder material is a terpolymer having the general structure

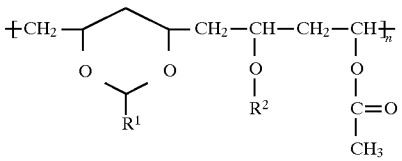

[I]

wherein:

(a) $R^1$ is selected from the group consisting of (i) lower alkyl substituted with 0–4 substituents selected from the group consisting of lower alkoxy, halogen and amino, and (ii) phenyl substituted with 0–3 substituents selected from the group consisting of lower alkoxy, halogen, amino and nitro;

(b) $R^2$ is hydrogen, —$R^3$—N—$R^4$, or —$R^3$—OH, wherein $R^3$ is selected from the group consisting of (i) lower alkylene substituted with 0–4 substituents selected from the group consisting of lower alkoxy, halogen and amino, and optionally containing 1–3 ether linkages, (ii) phenylene substituted with 0–3 substituents selected from the group consisting of lower alkoxy, halogen, amino and nitro, and (iii) —CO—Y—, wherein Y is lower alkylene substituted with 0–4 substituents selected from the group consisting of lower alkoxy, halogen and amino, and optionally containing 1–3 ether linkages, or phenylene substituted with 0–3 substituents selected from the group consisting of lower alkoxy, halogen, amino and nitro, and further wherein $R^4$ is selected from the group consisting of (iv) lower alkylene substituted with 0–4 substituents selected from the group consisting of lower alkoxy, halogen and amino, (v) phenylene substituted with 0–3 substituents selected from the group consisting of lower alkoxy, halogen, amino and nitro, and (vi) lower acyl; and (c) n is an integer indicating the number of mer units in the terpolymer.

9. The composite organic photoconductor of claim 8, wherein $R^1$ includes a substituent moiety selected from the group consisting of —I, —SH, —$NO_2$, —CN, —$NH_2$, —$SO_2$, and —OX, where X is either hydrogen or lower alkyl.

10. The composite organic photoconductor of claim 4, wherein the first binder material is a copolymer, comprising (A) first mer units having the structure

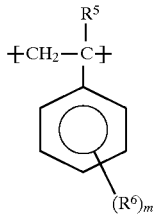

[II]

wherein (i) $R^5$ is selected from the group consisting of (a) hydrogen, (b) lower alkyl substituted with 0–4 substituents selected from the group consisting of lower alkoxy, halogen and amino, and (c) phenyl substituted with 0–3 substituents selected from the group consisting of lower alkoxy, halogen, amino and nitro, (ii) $R^6$ is selected from the group consisting of lower alkyl, lower alkoxy, halogen, amino and nitro, and (iii) m is an integer in the range of 1–5 inclusive; and (B) second mer units having the structure

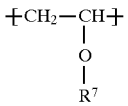

[III]

wherein $R^7$ is hydrogen, —$R^8$—NH—$R^9$, or —$R^8$—OH, and (a) $R^8$ is selected from the group consisting of (i) lower alkylene substituted with 0–4 substituents selected from the group consisting of lower alkoxy, halogen and amino, and optionally containing 1–3 ether linkages, (ii) phenylene substituted with 0–3 substituents selected from the group consisting of lower alkoxy, halogen, amino and nitro, and (iii) —CO—Z—, wherein Z is lower alkylene substituted with 0–4 substituents selected from the group consisting of lower alkoxy, halogen and amino, or phenylene substituted with 0–3 substituents selected from the group consisting of lower alkoxy, halogen, amino and nitro, and further wherein (b) $R^9$ is selected from the group consisting of (i) lower alkylene substituted with 0–4 substituents selected from the group consisting of lower alkoxy, halogen and amino, (ii) phenylene substituted with 0–3 substituents selected from the group consisting of lower alkoxy, halogen, amino and nitro, and (iii) lower acyl.

11. The composite organic photoconductor of claim 4, wherein the first binder material is a copolymer, comprising (A) first mer units having the structure

[II]

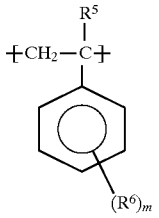

wherein (i) $R^5$ is selected from the group consisting of (a) hydrogen, (b) lower alkyl substituted with 0–4 substituents selected from the group consisting of lower alkoxy, halogen and amino, and (c) phenyl substituted with 0–3 substituents selected from the group consisting of lower alkoxy, halogen, amino and nitro, (ii) $R^6$ is selected from the group consisting of lower alkyl, lower alkoxy, halogen, amino and nitro, and (iii) m is an integer in the range of 1–5 inclusive; and (B) second mer units having the structure

[IV]

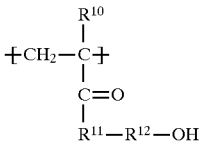

wherein (a) $R^{10}$ is selected from the group consisting of (i) hydrogen, (ii) lower alkyl substituted with 0–4 substituents selected from the group consisting of lower alkoxy, halogen and amino, and (iii) phenyl substituted with 0–3 substituents selected from the group consisting of lower alkoxy, halogen, amino and nitro, (b) $R^{11}$ is —O— or —NH—, and (c) $R^{12}$ is an alkylene or arylene group of 1–24 carbon atoms.

12. The composite organic photoconductor of claim 1, wherein the second colorant composition comprises a phthalocyanine pigment selected from the group consisting of alpha-, beta- or X-form hydrogen phthalocyanine ($H_2Pc$), vanadyl phthalocyanine (VOPc), magnesium phthalocyanine (MgPc), chloroindium phthalocyanine (ClInPc), titanyl phthalocyanine (TiOPc) or halogenated titanyl phthalocyanine, hydroxy gallium phthalocyanine (HOGaPc), bromoindium phthalocyanine (BrInPc), zinc phthalocyanine (ZnPc), and alpha-, beta- or epsilon-form copper phthalocyanine (CuPc).

13. The composite organic photoconductor of claim 1, wherein the second colorant composition comprises a Pyrrollo-pyrrole dye, a cyano dye, or a squarylium dye.

14. The composite organic photoconductor of claim 1, wherein the charge generation layer comprises a thin film of the second colorant composition that has been deposited on the charge transport layer using vacuum sublimation.

15. The composite organic photoconductor of claim 1, wherein the charge generation layer is formed by coating the charge transport layer with a solvated second colorant composition.

16. The composite organic photoconductor of claim 15, wherein the charge transport layer is coated with a dispersion formed by combining the solvated second colorant composition with a second binder material.

17. The composite organic photoconductor of claim 15, wherein the second binder material comprises a thermoplastic or thermoset resin.

18. The composite organic photoconductor of claim 16, wherein the second colorant composition is present at 0.1 wt. % to 100 wt. % relative to the second binder material.

19. The composite organic photoconductor of claim 18, wherein the second binder material is a terpolymer having the general structure

[I]

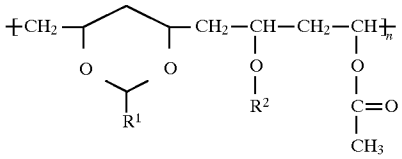

wherein:

(a) $R^1$ is selected from the group consisting of (i) lower alkyl substituted with 0–4 substituents selected from the group consisting of lower alkoxy, halogen and amino, and (ii) phenyl substituted with 0–3 substituents selected from the group consisting of lower alkoxy, halogen, amino and nitro;

(b) $R^2$ is hydrogen, —$R^3$—N—$R^4$, or —$R^3$—OH, wherein $R^3$ is selected from the group consisting of (i) lower alkylene substituted with 0–4 substituents selected from the group consisting of lower alkoxy, halogen and amino, and optionally containing 1–3 ether linkages, (ii) phenylene substituted with 0–3 substituents selected from the group consisting of lower alkoxy, halogen, amino and nitro, and (iii) —CO—Y—, wherein Y is lower alkylene substituted with 0–4 substituents selected from the group consisting of lower alkoxy, halogen and amino, and optionally containing 1–3 ether linkages, or phenylene substituted with 0–3 substituents selected from the group consisting of lower alkoxy, halogen, amino and nitro, and further wherein $R^4$ is selected from the group consisting of (iv) lower alkylene substituted with 0–4 substituents selected from the group consisting of lower alkoxy, halogen and amino, (v) phenylene substituted with 0–3 substituents selected from the group consisting of lower alkoxy, halogen, amino and nitro, and (vi) lower acyl; and (c) n is an integer indicating the number of mer units in the terpolymer.

20. The composite organic photoconductor of claim 19, wherein $R^1$ includes a substituent moiety selected from the group consisting of —I, —SH, —$NO_2$, —CN, —$NH_2$, —$SO_2$, and —OX, where X is either hydrogen or lower alkyl.

21. An electrophotographic method, comprising:

(a) providing a composite organic photoconductor having a conductive support, a charge generation layer and a charge transport layer disposed between said conductive support and said charge generation layer, wherein (i) the charge transport layer comprises a first colorant composition comprised of a pigment having an infrared absorption maximum of about 740 nm, and (ii) the charge generation layer comprises a second colorant composition having an infrared absorption maximum greater than about 770 nm;

(b) establishing a uniform charge on the composite organic photoconductor;

(c) exposing the composite organic photoconductor to light to form a latent image thereon; and (d) developing the latent image with a toner composition comprising pigment components.

22. The method of claim 21, wherein the toner composition is a liquid toner composition.

* * * * *